US008847845B2

(12) United States Patent
Ahring et al.

(10) Patent No.: US 8,847,845 B2
(45) Date of Patent: Sep. 30, 2014

(54) HOLDER FOR A MOVABLE SENSOR

(75) Inventors: Bernhard Ahring, Ingolstadt (DE); Horst Christof, Aying (DE)

(73) Assignee: EADS Deutschland GmbH, Ottobrunn (DE)

( * ) Notice: Subject to any disclaimer, the term of this patent is extended or adjusted under 35 U.S.C. 154(b) by 356 days.

(21) Appl. No.: 13/380,119

(22) PCT Filed: Jun. 21, 2010

(86) PCT No.: PCT/DE2010/000711

§ 371 (c)(1),
(2), (4) Date: Jan. 24, 2012

(87) PCT Pub. No.: WO2010/149140

PCT Pub. Date: Dec. 29, 2010

(65) Prior Publication Data

US 2012/0119973 A1 May 17, 2012

(30) Foreign Application Priority Data

Jun. 23, 2009 (DE) ..... 10 2009 030 239

(51) Int. Cl.
*H01Q 3/02* (2006.01)

(52) U.S. Cl.
USPC ..... 343/882

(58) Field of Classification Search
CPC ..... H01Q 1/125; H01Q 3/08; H01Q 1/084; H01Q 1/1235; H01Q 3/02
USPC ..... 343/882; 250/203.4
See application file for complete search history.

(56) References Cited

U.S. PATENT DOCUMENTS

| | | | | |
|---|---|---|---|---|
| 4,251,819 | A | 2/1981 | Vickland | |
| 4,360,182 | A | 11/1982 | Titus | |
| 4,415,130 | A | 11/1983 | Staehlin | |
| 4,550,319 | A * | 10/1985 | Ganssle et al. | 343/882 |
| 5,200,758 | A * | 4/1993 | Gillard | 343/880 |
| 5,351,060 | A * | 9/1994 | Bayne | 343/766 |
| 8,017,895 | B2 * | 9/2011 | Moser | 250/203.4 |
| 8,085,211 | B2 * | 12/2011 | Yang et al. | 343/766 |
| 8,350,204 | B2 * | 1/2013 | Moser | 250/203.4 |
| 2009/0050191 | A1 * | 2/2009 | Young et al. | 136/246 |

FOREIGN PATENT DOCUMENTS

| | | | |
|---|---|---|---|
| DE | 33 08 076 | A1 | 9/1984 |
| EP | 1 589 611 | A1 | 10/2005 |
| WO | WO 97/12806 | A1 | 4/1997 |
| WO | WO 2009/076394 | A1 | 6/2009 |

OTHER PUBLICATIONS

PCT/ISA/237 Form (Six (6) pages.
International Search Report including English language translation dated Nov. 5, 2010 (Eight (8) pages).

* cited by examiner

*Primary Examiner* — Huedung Mancuso
(74) *Attorney, Agent, or Firm* — Crowell & Moring LLP

(57) ABSTRACT

A mount for a movable sensor on a support structure is provided. The sensor is alignable with a sensor target. The mount includes at least two mutually spaced sensor-based bearings, at least two mutually spaced support-structure-based bearings, at least two longitudinally adjustable actuator units arranged between an associated sensor-based bearing and an associated support-structure-based bearing, and a center bearing that is configured to pivotably support the sensor on the support structure about a kinematic center point on at least two spatial axes.

3 Claims, 3 Drawing Sheets

Fig. 1
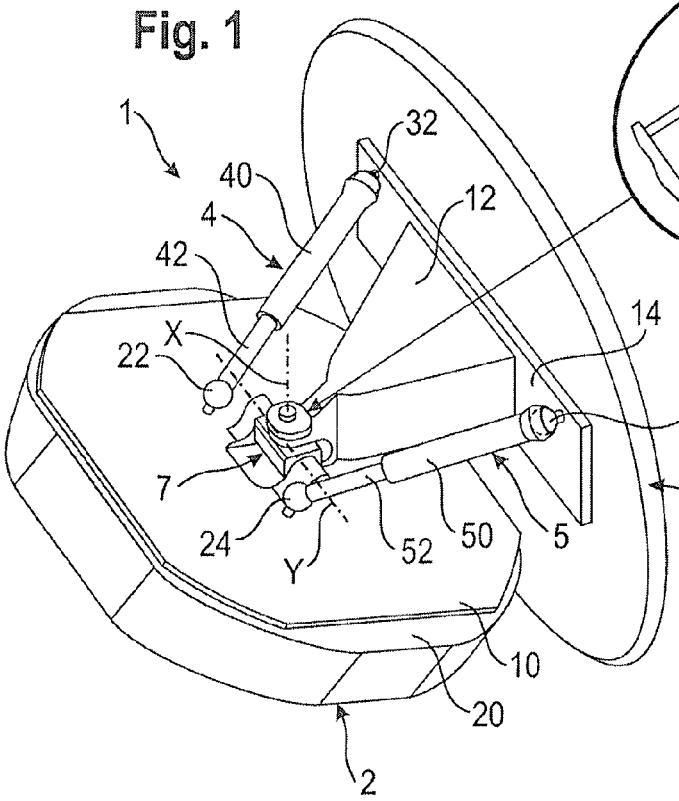
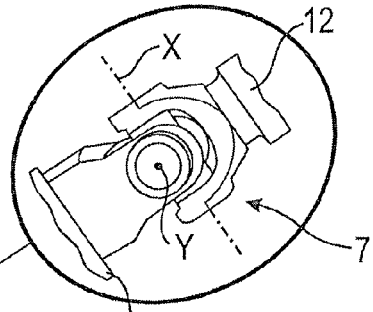
Fig. 1A
Fig. 2A
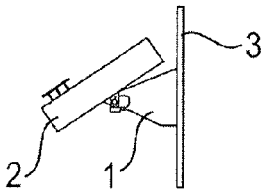
Fig. 2B
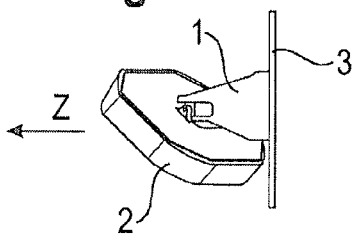
Fig. 2C
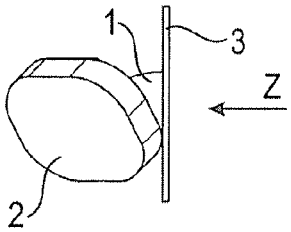
Fig. 2D
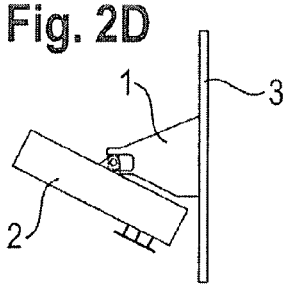

HOLDER FOR A MOVABLE SENSOR

CROSS-REFERENCE TO RELATED APPLICATIONS

The present application claims priority under 35 U.S.C. §119 to German Patent Application No. 10 2009 030 239.5, filed Jun. 23, 2009, the entire disclosure of which is herein expressly incorporated by reference.

BACKGROUND AND SUMMARY OF THE INVENTION

The invention relates to a mount for a movable sensor on a support structure, which sensor is alignable with a target. These sensors, by way of example, can be radar sensors, camera sensors, or transmitters and/or receivers of electromagnetic radiation in general.

The term "sensor" for an alignable functional element within the context of this invention is thus not limited to receiving devices, but can also include transmitting devices or combined transmitting/receiving devices for electromagnetic radiation.

In order to be able to align these sensors with a target, the sensor requires a movable mount. Particularly in cases where the support structure itself is also movable—for example, as a component on an aircraft, spacecraft, watercraft, or land vehicle—this mount must be capable of tracking so as to remain aligned with the target. This is also true whenever the target is moving.

Exemplary embodiments of the present invention provide a mount for a movable sensor on a support structure, which sensor is alignable with a target, wherein the mount is of a compact design, enables fast alignment of the sensor with the target, and furthermore allows for fast tracking by the sensor in the case of a moving target and/or a moving support structure.

The mount is equipped with at least two mutually spaced sensor-based bearings, at least two mutually spaced support-structure-based bearings, at least two longitudinally adjustable actuator units, wherein each of the actuator units is provided between an associated sensor-based bearing and an associated support-structure-based bearing, and a center bearing that is designed to support the sensor pivotably on the support structure about a kinematic pivot center and at least two spatial axes.

A sensor mount of this type features a very light and compact constructive design. Its kinematics allows for optimal tracking by the sensor (e.g., a radar antenna) within a very restricted space, such as, for example, the nose of an aircraft. The pivotability about at least two spatial axes, which are preferably perpendicular to each other, allows the sensor to be pivoted about the respective spatial axis in each direction within the pivot range defined by the corresponding design. Tracking by the sensor can also be effected continuously in each of these directions. This center bearing, which by way of example can be in the form of a universal joint, ensures the pivotability of the sensor, while the actuator units enable the pivot motion about the two spatial axes, which actuator units can be composed, for example, of longitudinally adjustable guide rods or struts and can include a servo drive.

A control device is preferably provided to control the respective servo drives of the actuator units, which device controls the longitudinal adjustment of each actuator unit and thus controls the pivot motion of the sensor. Kinematics of this type enables continuous sensor tracking in all directions in a light and compact constructive design while providing the optimum application of force and low masses to be rotated. The kinematics of the mount according to the invention thus allows the sensor—for example, a radar antenna—to track continuously within the pivot range defined by the design even where the coordinates of the target are changing continuously and a support structure is moving, such as, for example, a flying aircraft, or a ship or land vehicle when underway.

In accordance with exemplary embodiments of the present invention at least three mutually spaced sensor-based bearings are provided, at least three mutually spaced support-structure-based bearings are provided, that at least three longitudinally adjustable actuator units are provided, wherein each of the actuator units is provided between an associated sensor-based bearing and an associated support-structure-based bearing, and that the center bearing is designed to support the sensor pivotably on the support structure about a kinematic pivot center on three spatial axes.

This configuration of the mount additionally allows the sensor to be pivoted relative to the support structure about the third spatial axis. As a result, it is possible not only to have a sensor, which is in the form of a radar antenna or includes a radar antenna, to track, but also to always keep the polarization plane of the antenna constantly aligned relative to the target. This obviously also applies to other types of sensors that are preferably intended to be kept in constant alignment with the target—an aspect that also applies, for example, to imaging sensors within the wavelength range of visible light or in another wavelength range.

If, for example, this type of mount is employed in an aircraft, this advantageous development enables motions of the aircraft to be compensated on the pitch axis, (lateral axis) and yaw axis (vertical axis), as well as motions of the aircraft on the roll axis (longitudinal axis). The motions of the sensor target can also be compensated accordingly.

The sensor-based bearings preferably each include a kinematic center point about which the respective bearing allows a pivot motion on three spatial axes. To this end, the sensor-based bearings are preferably in the form of a spherical-joint-type bearings.

In another preferred embodiment, the kinematic center points of the sensor-based bearings are located on a common plane.

It is also advantageous for the support-structure-based bearings to each have a kinematic center point about which the respective bearing allows a pivot motion on three spatial axes. Here too, the support-structure-based bearings are preferably in the form of spherical-joint-type bearings.

The kinematic bearing center points of the support-structure-based bearings are preferably located in a common plane.

It is furthermore advantageous for the kinematic pivot center point of the center bearing to be located in the plane of the kinematic bearing center points of the sensor-based bearings or in the plane of the kinematic bearing center points of the support-structure-based bearings.

The sensor advantageously includes a transmitting and/or receiving antenna. In an especially preferred embodiment of the invention, the sensor is in the form of a radar sensor and includes, for example, a radar antenna. However, the invention is not limited to a radar sensor. Instead, the mount according to the invention is also applicable to other sensors such as, for example, imaging sensors or other types of antennas, or also, for example, an echo sounding apparatus. The invention is not limited here to the case in which the sensor includes or constitutes a receiver or an antenna thereof. The sensor instead is an alignable functional element that within the definition of the term "sensor" in this application can be composed device or an antenna thereof, or can include this antenna, or can constitute a combination of transmitting and receiving device or antennas relating thereto. Also understood as a transmitting device within this meaning is, for example, an energy-beam-emitter (for example, a laser-beam emitter) of a directed-energy weapon.

Preferred embodiments of the invention are described and explained in more detail below, including additional design details and further advantages, with reference to the attached drawings.

BRIEF DESCRIPTION OF THE DRAWINGS

In the drawings:

FIG. 1 depicts a first embodiment of the mount according to the invention;

FIG. 1A is an enlarged section from FIG. 1 illustrating the center bearing;

FIGS. 2A through 2D depict the mount according to the invention when in four different pivot positions;

DETAILED DESCRIPTION OF PREFERRED EMBODIMENTS

Figure 3:
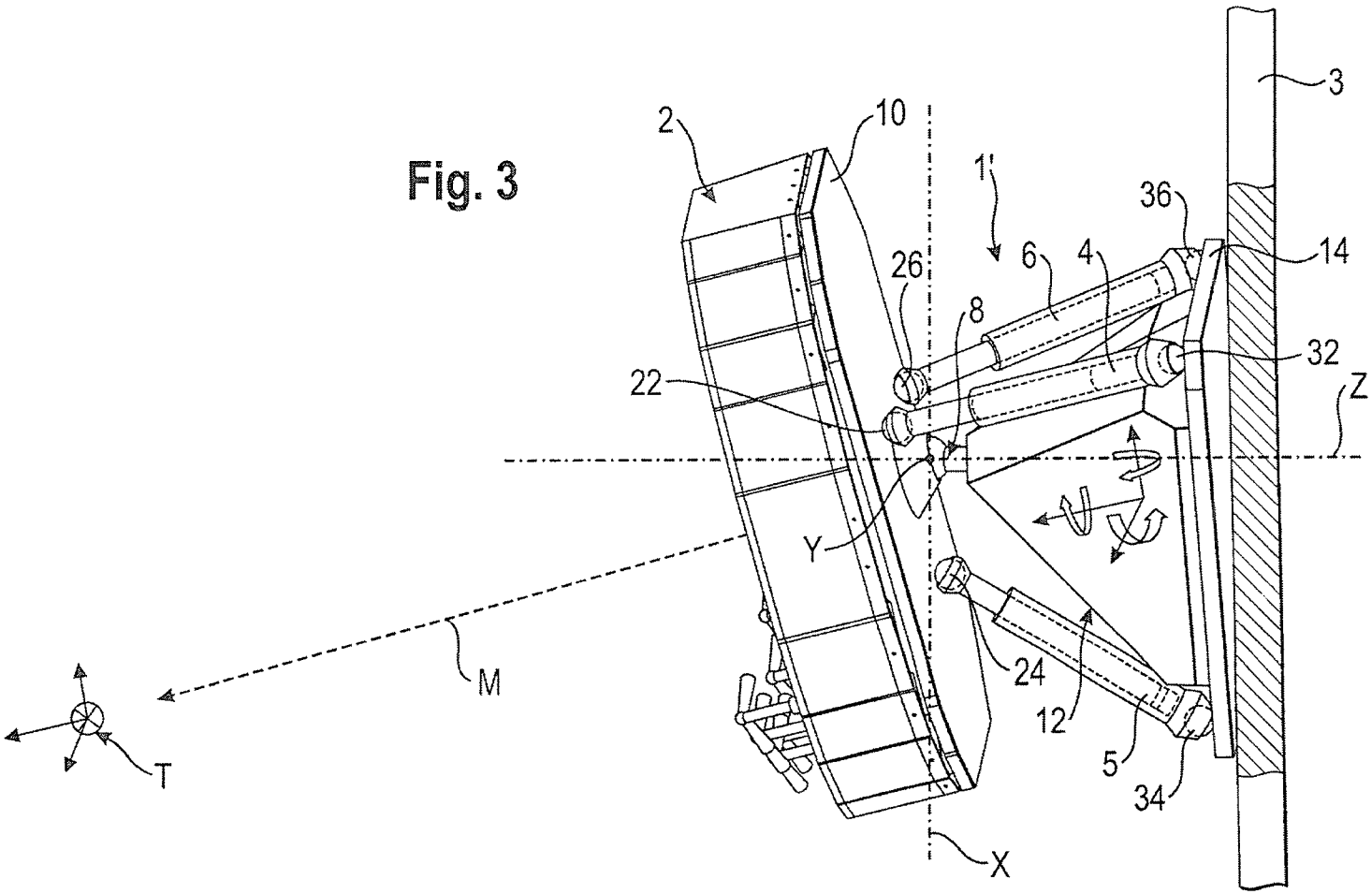
FIG. 3 is a second embodiment of this invention.

FIG. 1 depicts a first embodiment of the mount 1 according to the invention that supports a sensor 2 on a support structure 3. To this end, a sensor-based support plate 10 is connected to a sensor back wall 20 of sensor 2.

Sensor-based support plate 10 of mount 1 includes two mutually spaced sensor-based bearings 22, 24 on which actuator units 4, 5 are installed so as to articulate. Sensor-based bearings 22, 24 are of a spherical-joint-type design and thus enable a relative pivoting in all directions about a bearing center point by respective actuator units 4, 5 relative to sensor-based support plate 10.

Sensor-based support plate 10 furthermore includes a central or center bearing 7 that supports sensor-based support plate 10 on a bracket 12 on two spatial axes X, Y that run perpendicular to each other.

Bracket 12 is provided on a support-structure-based support plate 14 that in turn is installed on support structure 3.

Support-structure-based support plate 14 includes two mutually spaced support-structure-based bearings 32, 34 by which actuator units 4 or 5 are pivotably mounted in spherical-joint-type fashion about a respective bearing center point.

Actuator units 4, 5 each include an outer housing body 40, 50, as well as an inner housing body 42, 52. Each inner housing body 42, 52 is accommodated in longitudinally movable fashion within associated outer housing body 40, 50. The free end of inner housing body 42, 52 is supported in articulating fashion, as already described, by the associated support-structure-based bearings 22, 24 on sensor-based support plate 10. The free end of outer housing body 40, 50 is supported in articulating fashion, as already described, by associated support-structure-based bearing 32, 34 on support-structure-based support plate 14.

Actuator units 4, 5 each include an actuator—not shown—that effects an axial relative movement between respective housing body, 40, 50, and respective inner housing body 42, 52. Actuator units 4, 5 can include, for example, a known rack-and-pinion drive, worm-gear drive, or another translational drive. It is advantageous to provide a linear drive for especially rapid axial relative movements.

The example depicted in FIG. 1 reveals that the bearing center points of sensor-based bearings 22, 24, and the bearing center point of center bearing 7 are located in a common plane. At least one of sensor-based bearings 22, 24 must be laterally removed a certain distance from first axis X while the second of bearing 24, 22 must be laterally removed a certain distance from axis Y in order to enable actuator units 4, 5 to effect a pivoting of sensor 2 relative to support structure 3.

As FIG. 1A illustrates, center bearing 7 is in the form of a spherical joint, thereby producing a gimbaled mounting that allows pivoting about a kinematic pivot point, where the pivot point is defined by the intersection of axes X and Y. Pivoting about the pivot point is effected by longitudinally adjusting at least one of actuator units 4, 5, thereby shortening or lengthening the distance between respective sensor-based bearing 22, 24 associated with an actuator unit and support-structure-based bearing 32, 34 associated with this actuator unit.

This pivotability of sensor 2 relative to support structure 3 about the pivot point of center bearing 7 in any direction is illustrated in FIGS. 2*a* through 2D. FIG. 2*a* illustrates a position in which sensor 2 is pivoted upward. FIG. 2B illustrates a position in which sensor 2 (in viewing direction Z) is pivoted down to the right, while FIG. 2C illustrates a position in which sensor 2 is pivoted down to the left. FIG. 2D illustrates a position in which sensor 2 is pivoted directly down.

An alternative embodiment of this invention is illustrated in FIG. 3. Mount 1' includes sensor-based support plate 10 that is attached to sensor 2 and is connected through a center bearing 8 to a bracket 12 that is installed on a support-structure-based support plate 14, by means of which the entire mount is installed on support structure 3.

Unlike the embodiment of FIG. 1, however, center bearing 8 is in the form of a spherical joint in the embodiment illustrated in FIG. 3, with the result that this center bearing 8 supports sensor 2 pivotably on support structure 3 about the kinematic pivot center of the center bearing on three spatial axes X, Y, Z. The kinematic pivot center of this spherical-joint-type bearing 8 is the intersection of the three axes X, Y, Z.

Mount 1' comprises three actuator units 4, 5, 6 that are constructed in the same way as actuator units 4, 5 described with reference to FIG. 1, and that are in the same way supported in spherical-joint-type fashion on sensor-based support plate 10 or support-structure-based support plate 14 by means of sensor-based bearings 22, 24, 26 and support-structure-based bearings 32, 34, 36. The three sensor-based bearings 22, 24, 26 form the corners of a triangle on sensor-based support plate 10, spherical-joint-type center bearing 8 being located inside the triangle. Both the bearing centers of sensor-based bearings 22, 24, 26 as well as the pivot point of center bearing 8 are located in a common plane. Installing center bearing 8 at the center of sensor 2 has the effect that inertial forces are introduced, when sensor 2 rotates, through a central rotation point, specifically the bearing center of center bearing 8, thereby reducing or even preventing unbalances.

The respective other end of actuator units 4, 5, 6 is supported in a similar way on support-structure-based support plate 14 in each case by means of a spherical-joint-type support-structure-based bearing 32, 34, 36, as was described with reference to the embodiment of FIG. 1. Support-structure-based bearings 32, 34, 36 also form the corners of a triangle, longitudinal axis Z running completely through this triangle. Although support-structure-based bearings 32, 34, 36 in the example shown are also located in a common plane, this approach is not absolutely necessary in terms of function.

The advantage of mount 1 illustrated in FIG. 3 is the fact that sensor 2 can be pivoted by this mount not only about the two spatial axes X, Y, as is true for the embodiment of FIG. 1, but the fact that sensor 2 is also pivotable by mount 1' on longitudinal axis Z. If one considers by way of example installing sensor 2 by means of mount 1' on support structure 3 where this structure is a component of an aircraft, then longitudinal axis Z corresponds to the roll axis (longitudinal axis) of the aircraft, or at least runs parallel to this axis. The vertical axis runs parallel to the yaw axis (vertical axis) of the aircraft, while the lateral axis Y runs parallel to the pitch axis (lateral axis) of the aircraft. In this case, mount 1' can be used to compensate pitch motions of the aircraft by pivoting sensor 2 about axis Y. Yaw motions of the aircraft can be compensated by pivoting sensor 2 about vertical axis X, while roll motions of the aircraft can be compensated by pivoting sensor 2 about longitudinal axis Z. As a result, it is possible not only to compensate the pitch and yaw of the aircraft in order to align the orthogonal sensor axis M of sensor 2 with target T, thereby compensating the pitch and yaw motions of the aircraft so as to enable it to track, but it is furthermore possible to compensate the roll motions of the aircraft by rotating sensor 2 about axis Z, thereby preventing sensor 2 from rotating about sensor axis M out of position relative to target T. This is advantageous, for example, in sensors that have a predefined polarization plane. Mount 1' illustrated in FIG. 3 enables the polarization plane of sensor 2 to remain stable in space relative to target T even when the aircraft effects a roll motion about longitudinal axis Z.

Figure 4:
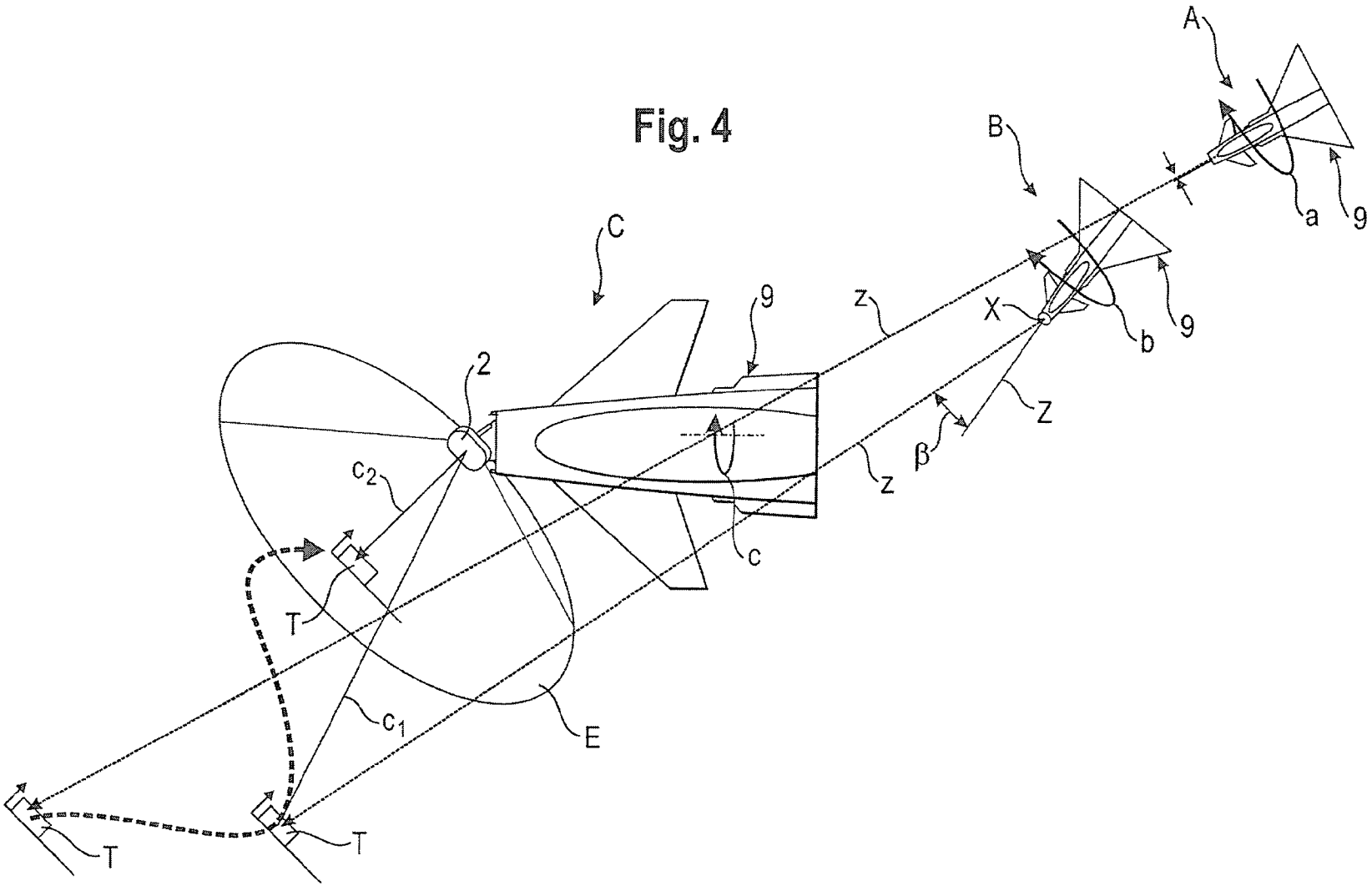
FIG. 4 depicts various operating conditions for the mount based on the second embodiment illustrated in FIG. 3.

These advantages of the embodiment of FIG. 3 are illustrated clearly by the diagram in FIG. 4. Various flight attitudes of an aircraft 9 are illustrated here. Longitudinal axis Z of the aircraft is aligned directly at target T in diagram A. No compensation is required in this case for the pitch and yaw motions of the aircraft. The aircraft can, however, roll about its longitudinal axis Z, as is indicated by arrow a. This roll motion can be compensated, as already described, by pivoting sensor 2 about the aircraft's longitudinal axis Z.

Diagram B illustrates aircraft 9 where the aircraft's longitudinal axis Z is no longer pointing at target T, which in the meantime has also moved away from its original position, as the broken line indicates. In this position, aircraft 9 has furthermore effected a yaw motion by angle β on axis z relative to the target. Yaw angle β, however, can be compensated by having mount 1' correspondingly pivot sensor 2 on axis X. In addition, aircraft 9 can also effect a roll motion in the position shown in B, as indicated by arrow b; this roll motion too is compensated by mount 1' by rotating sensor 2 on axis Z.

Finally, diagram C of aircraft 9 in FIG. 4 illustrates yet another positional change in target T, where it is assumed that the aircraft has not changed its flight heading and attitude. Initially, sensor 2 of aircraft 9 had aimed at target T in the direction indicated by arrow $c_1$. Target T has subsequently changed its position along the dashed arrow line, where a correction of the alignment with target T is effected by the controlled pivoting of sensor 2 on axes X and Y, as is indicated by arrow $c_2$.

Even if the aircraft effects a roll motion, indicated by arrow c, when correcting this boresight direction, the fix on moved target T is not lost and polarization plane E of sensor 2 does not change relative to moved target T.

The mount according to the invention thus allows compensation of the position of the target with which the sensor is aligned even when the target is moving. In addition, the mount according to the invention also allows the position and orientation of the sensor to be compensated whenever this sensor is installed on a moving carrier (aircraft, ship, land vehicle, or spacecraft). In the development of FIG. 3, it is even possible to prevent any relative motion between sensor and sensor target on the sensor axis including whenever the carrier (or also the sensor target) effects a roll motion on the corresponding longitudinal axis, thereby preventing any undesired twisting of the of the polarization plane on connecting axis M between sensor and sensor target.

The purpose of the reference numerals in the claims, description, and drawings is only to enhance understanding of the invention; they are not intended to limit the scope of protection.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMERALS

1 mount
1' mount
2 sensor
3 support structure
4 actuator units
5 actuator units
6 actuator units
7 center bearing (universal joint)
8 center bearing (spherical joint)
9 aircraft
10 sensor-based support plate
12 bracket
14 support-structure-based support plate
20 rear wall of sensor
22 sensor-based bearing
24 sensor-based bearing
26 sensor-based bearing
30 support structure base
32 support-structure-based bearing
34 support-structure-based bearing
36 support-structure-based bearing
40 outer housing body
42 inner housing body
50 outer housing body
52 inner housing body
T sensor target
M connecting axis
X spatial axis
Y spatial axis
Z spatial axis

The invention claimed is:

1. A mount for a movable sensor on a support structure, which sensor is alignable with a sensor target on a support structure, comprising:

at least three mutually spaced sensor-based bearings;

at least three mutually spaced support-structure-based bearings;

at least three longitudinally adjustable actuator units configured between an associated sensor-based bearing and an associated support-structure-based bearing; and a center bearing configured to pivotably support the movable sensor on the support structure about a kinematic center point on at least three spatial axes, wherein the sensor-based bearings each have a kinematic bearing center point about which the respective bearing allows a pivot motion on three spatial axes, wherein the sensor-based bearings are spherical-joint-type bearings, wherein the kinematic bearing center points of the sensor-based bearings are located in a common plane, and wherein the kinematic pivot point of the center bearing is located in the plane of the kinematic center points of the sensor-based bearings.

2. The mount according to claim 1, wherein the sensor includes a transmitting antenna or receiving antenna.

3. The mount according to claim 1, wherein the sensor includes a radar antenna.

* * * * *